US011041657B2

(12) United States Patent
Mori et al.

(10) Patent No.: US 11,041,657 B2
(45) Date of Patent: Jun. 22, 2021

(54) HOT-WATER SUPPLY APPARATUS

(71) Applicant: RINNAI CORPORATION, Nagoya (JP)

(72) Inventors: Kentaro Mori, Nagoya (JP); Hideyuki Jinno, Nagoya (JP)

(73) Assignee: RINNAI CORPORATION, Nagoya (JP)

( * ) Notice: Subject to any disclaimer, the term of this patent is extended or adjusted under 35 U.S.C. 154(b) by 34 days.

(21) Appl. No.: 16/055,422

(22) Filed: Aug. 6, 2018

(65) Prior Publication Data

US 2019/0049147 A1 Feb. 14, 2019

(30) Foreign Application Priority Data

Aug. 8, 2017 (JP) ..... JP2017-153452

(51) Int. Cl.

| | |
|---|---|
| ***F24H 1/18*** | (2006.01) |
| ***F24H 9/06*** | (2006.01) |
| ***F24H 9/02*** | (2006.01) |
| ***F24H 9/20*** | (2006.01) |
| *B01B 1/00* | (2006.01) |

(52) U.S. Cl.

CPC ..... *F24H 1/181* (2013.01); *F24H 9/02* (2013.01); *F24H 9/06* (2013.01); *F24H 9/20* (2013.01); *B01B 1/00* (2013.01)

(58) Field of Classification Search

CPC ... F24H 1/181; F24H 1/10; F24H 9/02; F24H 9/06; F24H 9/20; F24H 9/2007

USPC ..... 237/56

See application file for complete search history.

(56) References Cited

U.S. PATENT DOCUMENTS 3,019,864 A * 2/1962 Lester ..... F24H 9/02 52/407.1
3,357,419 A * 12/1967 Duchinsky ..... F24H 9/02 126/114
4,227,068 A * 10/1980 Carter ..... F24H 3/002 165/129
4,354,481 A * 10/1982 Welden ..... F24H 1/10 122/10

(Continued)

FOREIGN PATENT DOCUMENTS

JP 58075654 A * 5/1983 ..... F24H 9/06
JP 2001-099483 4/2001
KR 2014-0127546 A 11/2014

OTHER PUBLICATIONS

"Definition—Bumper—Dictionary.com.pdr", definition "bumper", Dec. 21, 2019.*
Chinese Office Action dated Nov. 25, 2020, 7 pages.

*Primary Examiner* — Daniel E. Namay
(74) *Attorney, Agent, or Firm* — Rankin, Hill & Clark LLP

(57) ABSTRACT

A hot-water supply apparatus capable of restraining the occurrence of noises from a building wall surface side includes a hot-water supply apparatus main body having a burner and a heat exchanger that generates hot water by combustion exhaust of the burner, and a rectangular parallelepiped main body case that houses the hot-water supply apparatus main body. A back plate (5*c*), which closes the back side of the main body case, is installed to a building wall surface (W) such that the back plate (5*c*) opposes the building wall surface (W) with a predetermined void space (S) provided therebetween. A soundproof member (18), which closes at least a part of an open end of the void space (S), is provided on the main body case (5).

10 Claims, 7 Drawing Sheets

(56) References Cited

U.S. PATENT DOCUMENTS

| | | | | | |
|---|---|---|---|---|---|
| 4,756,475 | A * | 7/1988 | Vergne | F24H 9/148 | 237/56 |
| 5,659,657 | A * | 8/1997 | Overdorf | F21V 15/00 | 219/524 |
| 5,682,666 | A * | 11/1997 | Lannes | F24H 9/06 | 122/13.01 |
| 5,761,379 | A * | 6/1998 | Lannes | F24H 1/182 | 122/13.01 |
| 5,810,246 | A * | 9/1998 | Cote | F24H 1/43 | 122/367.1 |
| 6,256,456 | B1 * | 7/2001 | DeSantis | F24H 1/181 | 219/536 |
| 9,027,359 | B2 * | 5/2015 | O'Brien | F24D 3/082 | 62/175 |
| 10,072,873 | B1 * | 9/2018 | Ostera | F24H 1/103 | |
| 2002/0100854 | A1 * | 8/2002 | Stansbury | C07C 335/26 | 248/632 |
| 2011/0041536 | A1 * | 2/2011 | O'Brien | F24D 3/082 | 62/238.6 |
| 2011/0154838 | A1 * | 6/2011 | O'Brien | F24D 11/0214 | 62/132 |
| 2013/0319347 | A1 * | 12/2013 | Fioriti | F24H 1/10 | 122/13.01 |
| 2014/0355967 | A1 * | 12/2014 | Chu | F24H 9/02 | 392/373 |
| 2016/0033168 | A1 * | 2/2016 | Ota | F24H 9/06 | 29/464 |
| 2016/0084524 | A1 * | 3/2016 | Chu | F24H 3/002 | 392/370 |
| 2018/0058720 | A1 * | 3/2018 | Ando | F24H 9/0005 | |

* cited by examiner

HOT-WATER SUPPLY APPARATUS

BACKGROUND OF THE INVENTION

Field of the Invention

The present invention relates to a hot-water supply apparatus installed on a wall surface of a building.

Description of the Related Art

This type of hot-water supply apparatus is installed by locking a main body case, which houses the main body of a hot-water supply apparatus therein, onto a wall surface of a building. When the hot-water supply apparatus is operated, the combustion of a burner generates heat. For this reason, the main body case is installed apart from a building wall surface by a predetermined distance, thereby reducing the heat transmitted from the hot-water supply apparatus to the building wall surface (refer to, for example, FIG. 1 in Japanese Patent Application Laid-Open No. 2001-99483 (Patent Document 1)).

Inconveniently, however, in this type of hot-water supply apparatus, the sound generated from the hot-water supply apparatus during an operation (the combustion sound of the burner) resounds relatively loudly between the rear surface of the main body case and the building wall surface, leading to a noise in some cases.

SUMMARY OF THE INVENTION

In view of the above background, an object of the present invention is to provide a hot-water supply apparatus capable of restraining the generation of noises from a building wall surface side.

To this end, a hot-water supply apparatus according to the present invention includes: a hot-water supply apparatus main body having a burner and a heat exchanger that generates hot water by a combustion exhaust of the burner; and a rectangular parallelepiped main body case that houses the hot-water supply apparatus main body, wherein a back plate that closes a back side of the main body case is installed to a building wall surface such that the back plate opposes the building wall surface with a predetermined void space provided therebetween, and the main body case is provided with a soundproof member that closes at least a part of an open end of the void space.

When the hot-water supply apparatus is in operation, the hot-water supply apparatus main body housed in the main body case produces vibrations. The vibrations are transmitted from the inside of the main body case to the back plate and then the vibrations of the back plate are transmitted to the void space between the back plate and the building wall surface (hereinafter referred to as "the wall-side void space"). When the vibrations are released as a sound, the sound resonates in the wall-side void space and turns into a noise in some cases.

The present inventors have measured the frequencies (Hz), sound pressures (dB) and the like of the sounds generated from a hot-water supply apparatus and obtained new findings on the relationship between the sounds (vibrations) generated from the hot-water supply apparatus main body and the wall-side void space. According to the new findings, a noise generated from the back side of the hot-water supply apparatus is clearly caused by the resonance of a sound (vibration) generated from the hot-water supply apparatus main body, the resonance coinciding (substantially coinciding) with a resonant frequency which is an intrinsic frequency of the wall-side void space (hereinafter referred to as "the natural frequency").

The present invention is based on the findings obtained by the present inventors. More specifically, a sound transmission space is divided by closing a part of an open end of the wall-side void space by a soundproof member, and the shape of the space formed by the wall-side void space and an outer surrounding area that continues from the wall-side void space is changed. The change in the space shape of the wall-side void space changes the natural frequency of the wall-side void space, so that the frequency generated from the hot-water supply apparatus main body no longer coincides with the foregoing resonant frequency. This makes it possible to restrain the resonance in the wall-side void space, thus restraining the generation of noises.

The soundproof member functions not only to change the space shape of the wall-side void space thereby to change the natural frequency as described above but also to block the passing of a sound. Therefore, in the present invention, it is possible to add an effect for reducing the dissipation of a sound from the wall-side void space by providing a soundproof member that closes the full or substantially full circumference of the open end of the wall-side void space.

Further, in the present invention, the soundproof member is preferably extendedly provided in a vertical direction along at least one end edge of the back plate of the main body case.

This type of hot-water supply apparatus is attached to a building wall surface, the top and the bottom of the back surface side thereof being installed through mounting metal fixtures, such as brackets. Therefore, the wall-side void space is open relatively spaciously in a horizontal direction. Hence, providing a soundproof member that extends in the vertical direction along an end edge in the horizontal direction of the back plate makes it possible to obtain high anti-noise effect by a minimal soundproof member.

DESCRIPTION OF THE PREFERRED EMBODIMENTS

Figure 1:
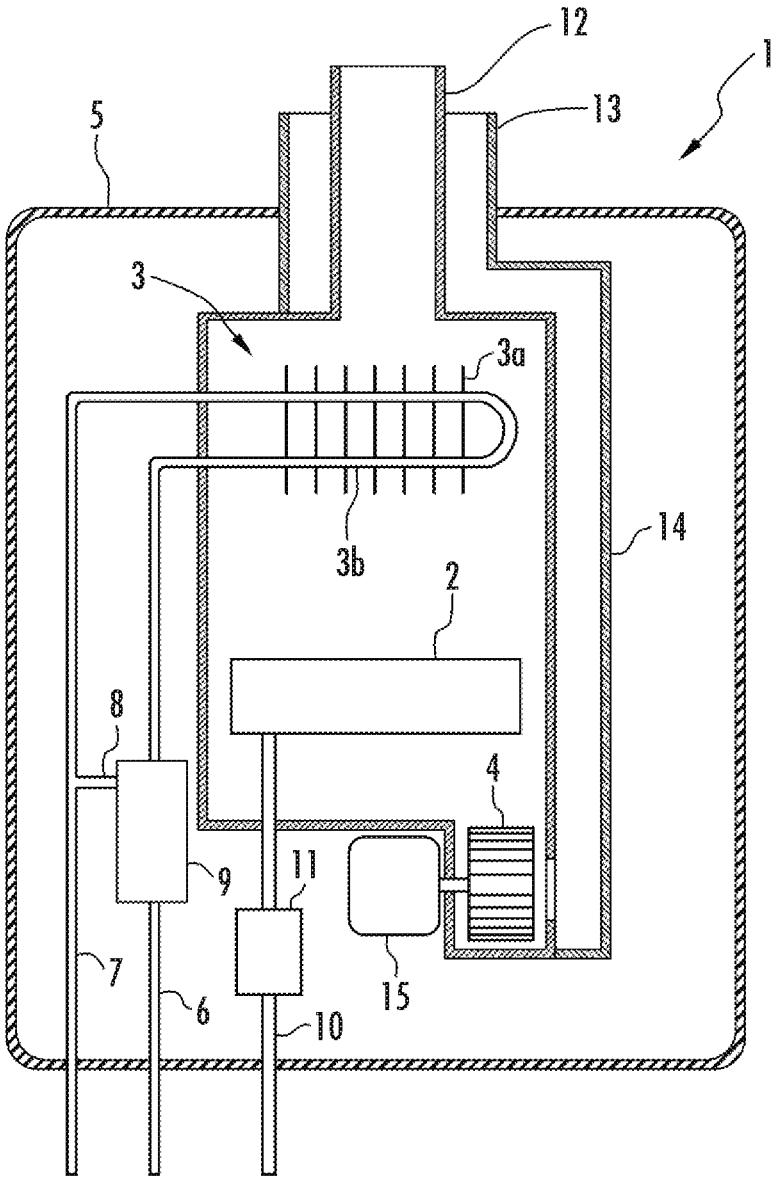
FIG. 1 is an explanatory front view schematically illustrating the configuration of a hot-water supply apparatus according to an embodiment of the present invention.

An embodiment of the present invention will be described with reference to the accompanying drawings. Referring to FIG. 1, a hot-water supply apparatus 1 according to the present embodiment includes a burner 2, a heat exchanger 3 disposed above the burner 2, and a combustion fan 4 disposed below the burner 2. The burner 2, the heat exchanger 3, and the combustion fan 4 constitute a hot-water supply apparatus main body in the present invention. The hot-water supply apparatus main body is housed in a main body case 5.

A water supply pipe 6 is connected to an inlet (a connection port on an upstream side) of the heat exchanger 3. A hot water delivery pipe 7 is connected to an outlet (a connection port on a downstream side) of the heat exchanger 3. The heat exchanger 3 has many heat absorbing fins 3*a* and heat absorbing pipes 3*b* passing through the heat absorbing fins 3*a*. Water supplied from waterworks (not illustrated) to the water supply pipe 6 is heated by the heat exchange with a combustion exhaust gas of the burner 2 in the heat exchanger 3 and then sent out to the hot water delivery pipe 7 to be delivered through, for example, a water faucet (not illustrated).

The water supply pipe 6 and the hot water delivery pipe 7 are in communication through a bypass pipe 8 that bypasses the heat exchanger 3. Provided on the upstream side and the downstream side of the place connected with the bypass pipe 8 in the water supply pipe 6 are a valve device (not illustrated), which regulates the water flow rate in the water supply pipe 6 and the bypass pipe 8, and a water amount regulating mechanism 9 composed of a flow rate sensor.

A gas supply passage 10 through which a fuel gas is supplied is connected to the burner 2. The gas supply passage 10 is provided with a gas supply valve mechanism 11 composed of a plurality of valve devices (including a gas main valve, gas proportional valves or the like, none of which are illustrated) for controlling the combustion of the burner 2 by regulating the amount of a fuel gas supplied to the burner 2.

After the heat exchange is performed in the heat exchanger 3, the combustion exhaust gas of the burner 2 is discharged outdoors through an exhaust pipe 12 penetrating the top of the main body case 5. The exhaust pipe 12 is surrounded by an air supply pipe 13, and the air supply pipe 13 is connected to a suction duct 14 in communication with an air inlet of the combustion fan 4.

The combustion fan 4 is rotatively driven by a fan motor 15 to supply outside air taken in through the air supply pipe 13 to the burner 2 as the air for combustion and also to feed the combustion exhaust gas of the burner 2 to the heat exchanger 3 and then discharge the combustion exhaust gas through the exhaust pipe 12.

Figure 2:
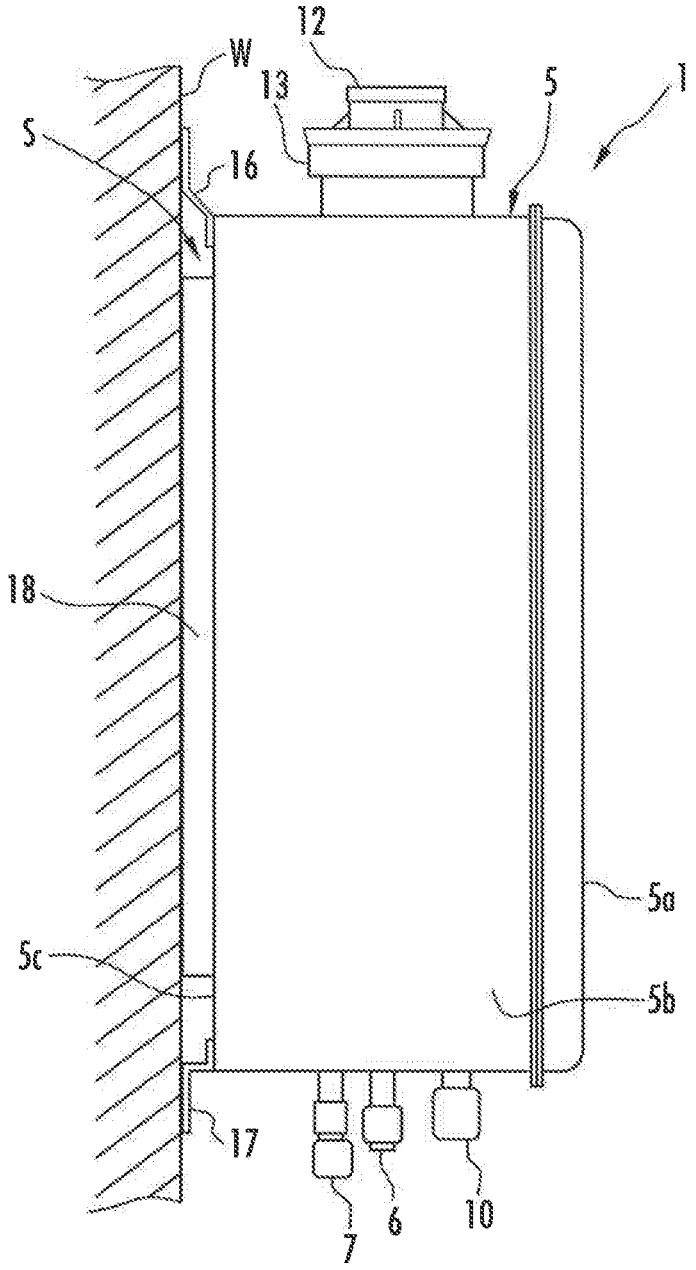
FIG. 2 is an explanatory side view illustrating the hot-water supply apparatus according to the embodiment of the present invention which has been installed to a building wall surface.

Referring to FIG. 2, the main body case 5 is composed of a front panel 5*a*, which can be opened and closed, and a body section 5*b*, and the back of the body section 5*b* is closed by a back plate 5*c*, thus forming the main body case 5 like a rectangular parallelepiped. The main body case 5 is attached to a building wall surface W by upper and lower brackets 16 and 17, respectively, of the body section 5*b*. The main body case 5 attached to the building wall surface W has the back plate 5*c* opposing the building wall surface W with a wall-side void space S provided therebetween.

Figure 3:
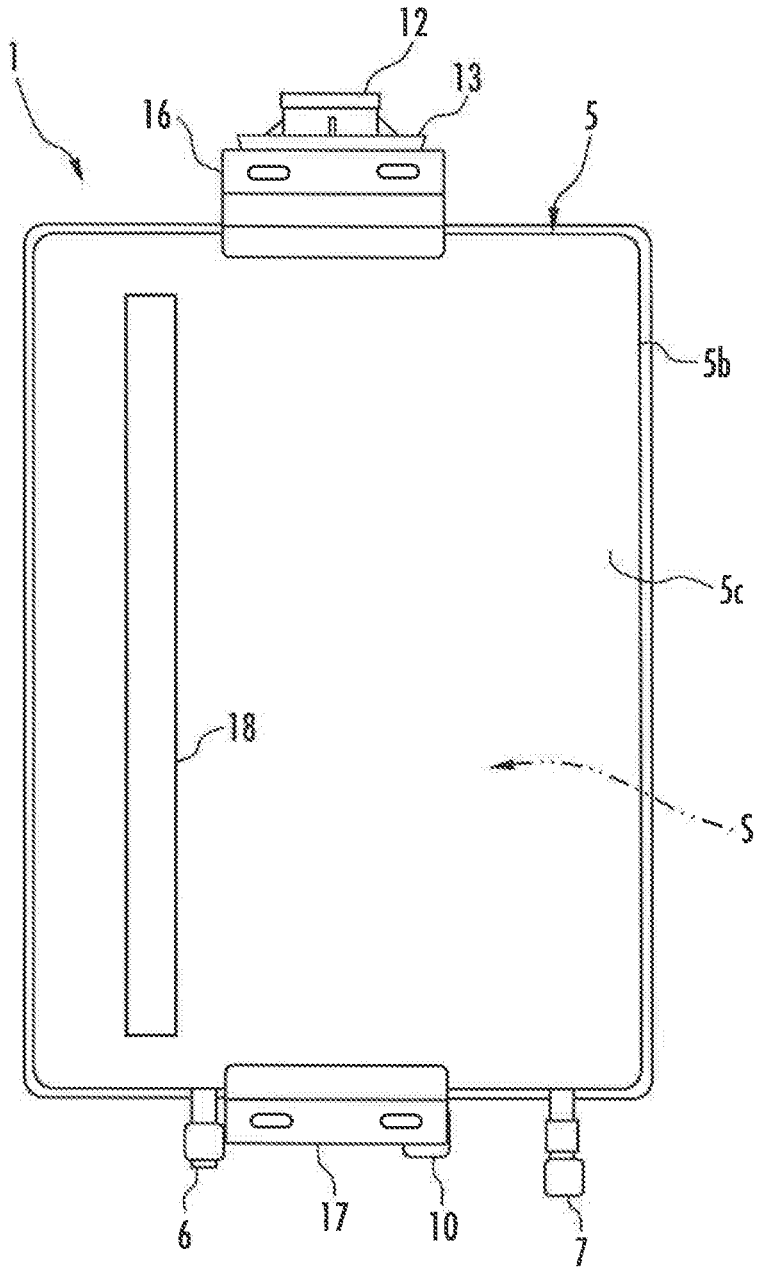
FIG. 3 is a diagram illustrating a back plate and a soundproof member in the embodiment of the present invention.

Referring to FIG. 3, the back plate 5*c* of the main body case 5 is provided with a soundproof member 18, which extends in the vertical direction along the end edge in the horizontal direction thereof. The wall-side void space S formed between the back plate 5*c* of the main body case 5 and the building wall surface W has an open end except for a part where the main body case 5 is connected to the building wall surface W by the brackets 16 and 17.

The soundproof member 18 is provided at a position that is on the inner side by a predetermined distance from one end edge in the horizontal direction of the back plate 5*c* in the open end of the wall-side void space S. The soundproof member 18 is formed like a quadrangular prism, and one side surface thereof is fixed in close contact with the back plate 5*c*, and the other side surface on the opposite side is in airtight contact with the building wall surface W.

Providing the soundproof member 18 reduces noises generated from the back side of the hot-water supply apparatus 1.

The following will describe the testing and the like conducted by the present inventors in relation to the present invention. The inventors first performed measurement to check the natural frequency (Hz) of the wall-side void space S in a state in which the hot-water supply apparatus 1 is not provided with the soundproof member 18.

Figure 4A:
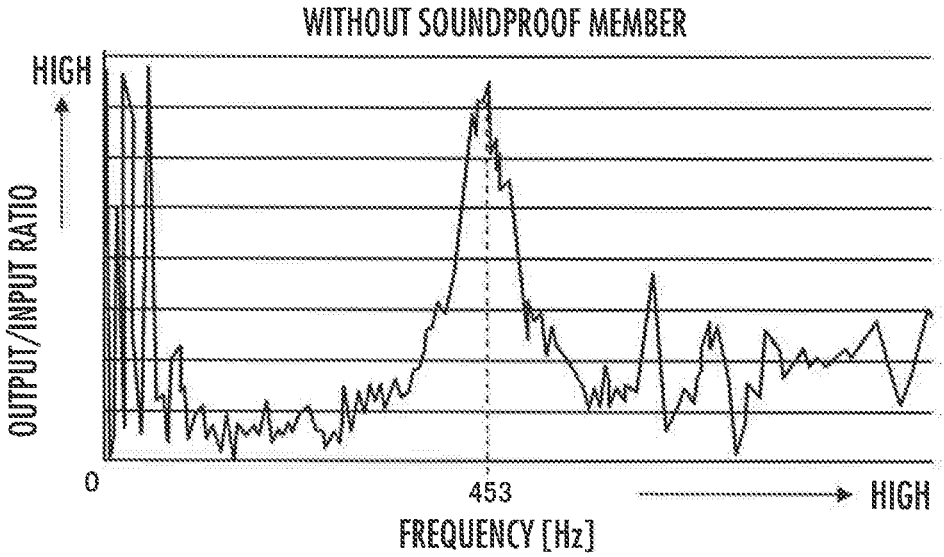
FIG. 4A is a graph illustrating the magnitude of the vibration for each frequency in a void space without the soundproof member.

More specifically, sound waves that have the same sound pressures but different frequencies were output from a testing speaker (not illustrated) toward the wall-side void space S from outside the wall-side void space S, and the loudness (magnitude) of each of the sounds (vibrations) at that time was measured using a microphone (not illustrated) installed inside (within) the wall-side void space S. The results indicated that the frequency at which a largest sound was acquired was 453 Hz, as illustrated in FIG. 4A.

Further, based on the space shape of the wall-side void space S, the natural frequency of the wall-side void space S was determined using a computer simulation. The calculation result indicated the value, 457 Hz, proving that the measurement result was approximately correct. Thus, it has been confirmed that the natural frequency of the wall-side void space S in the present embodiment is in the vicinity of 450 Hz.

Figure 5A:
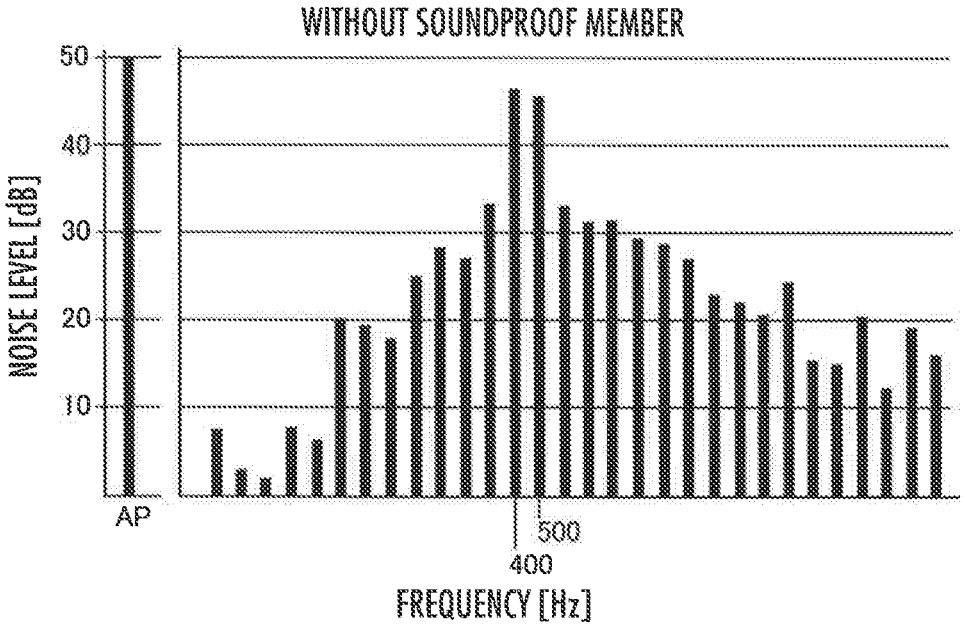
FIG. 5A is a graph illustrating the noise level for each frequency observed at the time of combustion of the hot-water supply apparatus without the soundproof member.

Then, the present inventors measured the frequencies (Hz) and the sound pressures (hereinafter referred to as "the noise level") (dB) of the sounds (vibrations) generated from the hot-water supply apparatus 1. As a result, it has been verified that the frequency of the wall-side void space S is high in the vicinity of 400 Hz (an actual measured value being 453 Hz), as illustrated in FIG. 5A.

The above demonstrates that the sounds generated from the hot-water supply apparatus 1 have resonated, substantially coinciding with the natural frequency of the wall-side void space S. In the present embodiment, the vibrations of frequencies in the vicinity of 400 Hz are the vibrations occurring at the time of combustion of the burner 2.

In the present embodiment, the soundproof member 18 extending in the vertical direction is provided along the end edge in the horizontal direction of the back plate 5*c* of the main body case 5, as illustrated in FIG. 3. The wall-side void space S continues to the space around the main body case 5, and one side in the horizontal direction of the open end of the wall-side void space S is closed by the soundproof member 18. With this arrangement, the transmission path of sounds, which is constituted of the wall-side void space S and the space around the wall-side void space S, is divided by the soundproof member 18.

Figure 4B:
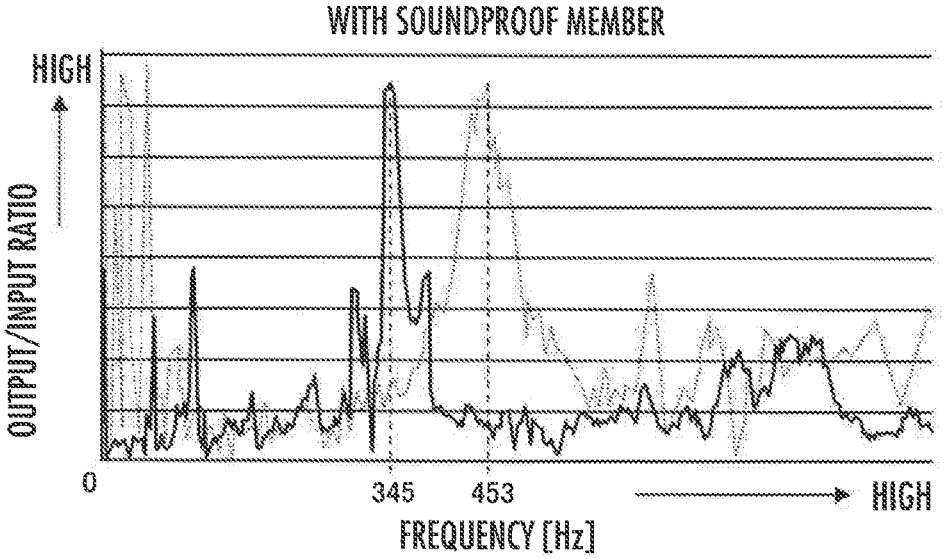
FIG. 4B is a graph illustrating the magnitude of the vibration for each frequency in the void space with the soundproof member.

The natural frequency of the wall-side void space S was determined using a computer simulation in the above case where the space is divided by the soundproof member 18. The calculation result indicated that the natural frequency of the wall-side void space S was changed to 376 Hz. Further, the natural frequency of the wall-side void space S was measured, and the measurement result verified that the natural frequency of the wall-side void space S was changed to 345 Hz, as illustrated in FIG. 4B. Changing the natural frequency of the wall-side void space S by the soundproof member 18 causes the frequency observed at the time of combustion of the burner 2 and the natural frequency of the wall-side void space S to no longer coincide with each other.

Figure 5B:
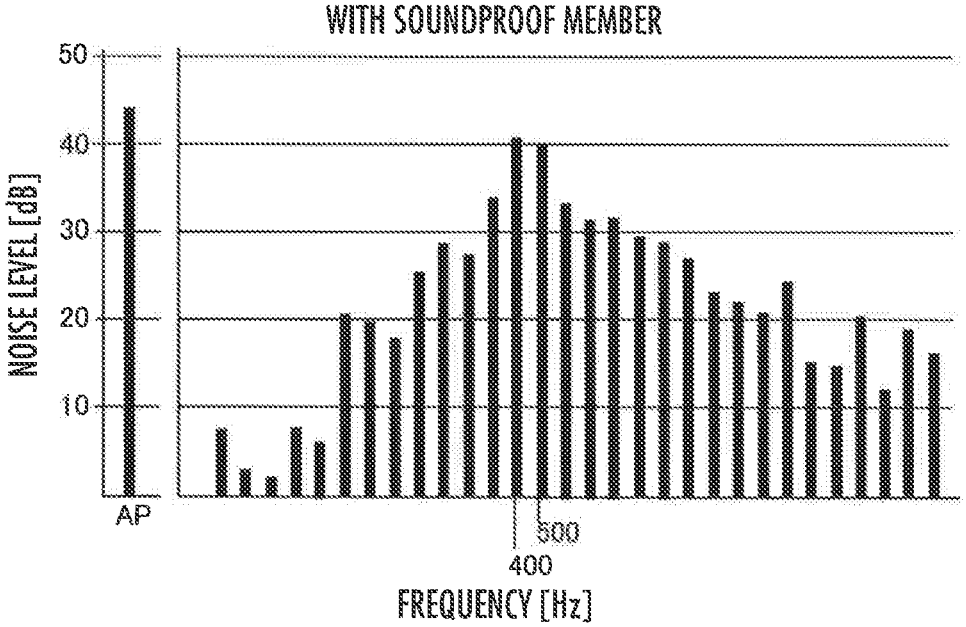
FIG. 5B is a graph illustrating the noise level for each frequency observed at the time of combustion of the hot-water supply apparatus with the soundproof member.

Thus, even when the 400-Hz vibrations occur in the wall-side void space S at the time of the combustion of the burner 2, there will be no resonance in the wall-side void space S. As illustrated in FIG. 5B, therefore, the noise level at the 400-Hz frequency has reduced to approximately 40 dB and the AP (entire frequency band) also reduced from 50 dB to approximately 45 dB, verifying that the noises generated from the wall-side void space S can be reduced.

Further, the soundproof member 18 formed of a relatively soft material makes it possible to reduce the transmission of vibrations from the back plate 5*c* to the building wall surface W, as compared with a case where the soundproof member 18 is formed of a hard material. In addition, it is preferable to form the soundproof member 18 in a relatively long and narrow shape so as to decrease the width dimension (the dimension in the direction orthogonal to the longitudinal direction) of the surface of the soundproof member 18, which is brought in airtight contact with the building wall surface W, thus making it possible to reduce the transmission of vibrations from the back plate 5*c* to the building wall surface W.

Figure 6:
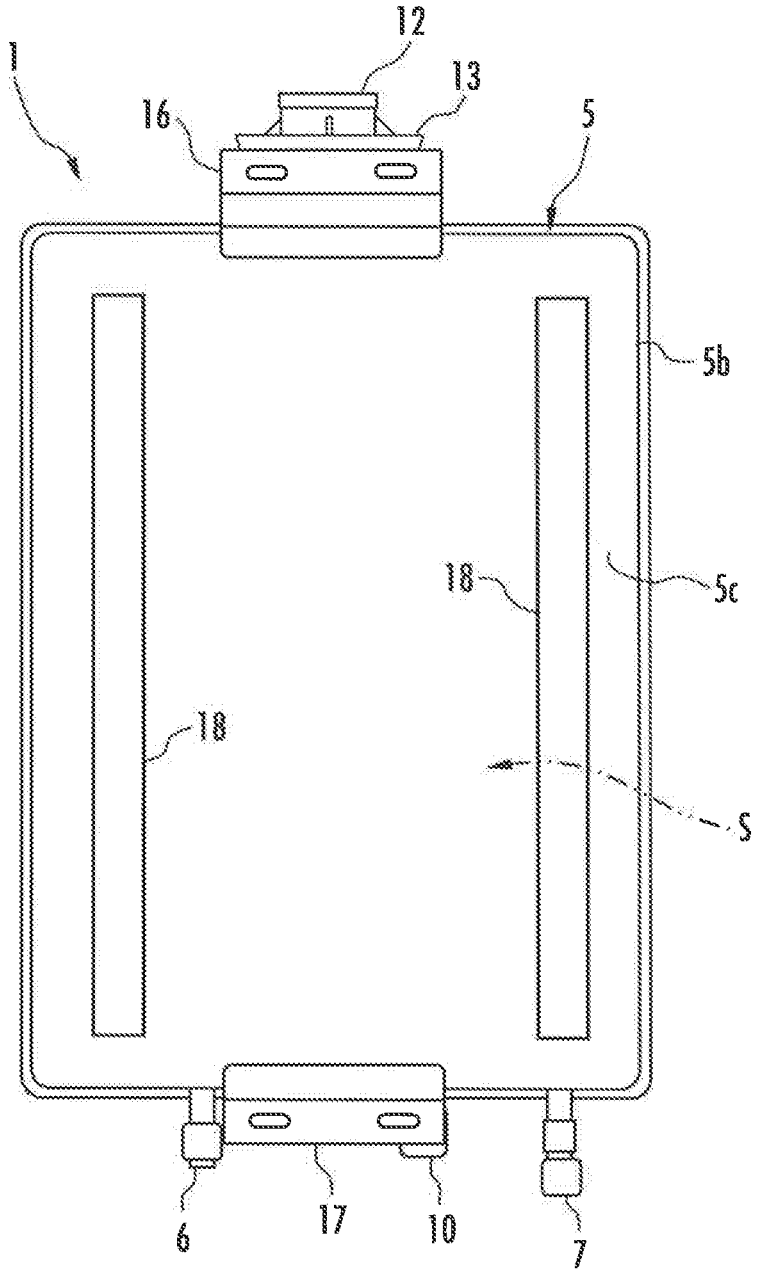
FIG. 6 is a diagram illustrating a modification example of the soundproof member in accordance with the present invention.

In the present embodiment, the description has been given of the example in which the soundproof member 18 is provided along one end edge in the horizontal direction of the back plate 5*c* of the main body case 5; however, the present invention is not limited thereto. For example, as illustrated in FIG. 6, a pair of soundproof members 18 may be provided along both end edges in the horizontal direction of the back plate 5*c* of the main body case 5.

In this case, the vibrations transmitted from the back plate 5*c* to the building wall surface W slightly increase, as compared with the case where the single soundproof member 18 is provided on one end edge in the horizontal direction of the back plate 5*c* (refer to FIG. 3). However, the calculated value of the natural frequency of the wall-side void space S is 280 Hz, thus making it possible to prevent coincidence with the frequency 400 Hz. Thus, in the case where the pair of the soundproof members 18 is provided along both end edges in the horizontal direction of the back plate 5*c* can also satisfactorily restrain the occurrence of noises attributable to the resonance in the wall-side void space S.

Further, the soundproof member 18 formed like a quadrangular prism has been adopted in the present embodiment; however, the shape of the soundproof member in the present invention is not limited thereto, and a soundproof member shaped like a plate or a block can be adopted. The soundproof member may have any shape insofar as the shape enables the wall-side void space S to be divided while restraining the transmission of vibrations from the back plate 5*c* to the building wall surface W.

Figure 7:
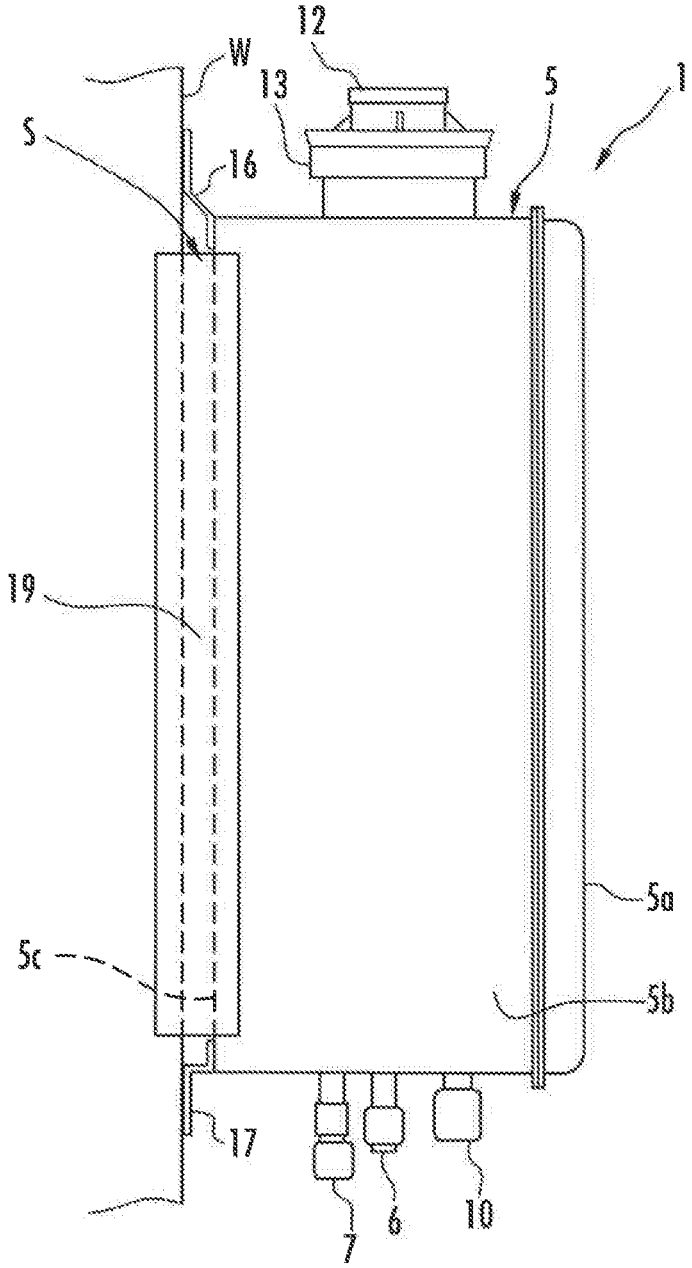
FIG. 7 is a diagram illustrating another modification example of the soundproof member in accordance with the present invention.

Further, for example, a tape-like soundproof member 19 may be provided on a side surface in the horizontal direction of a body section 5*b* of a main body case 5 to close an open end of a wall-side void space S between a back plate 5*c* and the building wall surface W, as illustrated in FIG. 7. This also enables the tape-like soundproof member 19 to change the natural frequency of the wall-side void space S thereby to restrain the occurrence of noises from the wall-side void space S. In addition, use of the tape-like soundproof member 19 makes it possible to minimize the transmission of the vibrations from the main body case 5 to the building wall surface W.

DESCRIPTION OF REFERENCE NUMERALS

1 . . . Hot-water supply apparatus; 2 . . . Burner; 3 . . . Heat exchanger; 5 . . . Main body case, 5*c* . . . Back plate; 18, 19 . . . Soundproof member; S . . . Wall-side void space (gap); and W . . . Building wall surface.

What is claimed is:

1. A hot-water supply apparatus comprising:

a hot-water supply apparatus main body having a burner and a heat exchanger that generates hot water by a combustion exhaust of the burner;

a rectangular parallelepiped main body case housing the hot-water supply apparatus main body; and an upper bracket and a lower bracket respectively provided adjacent a top end and a bottom end of a back plate that closes a back side of the main body case, wherein the main body case is attached to a building wall surface by the upper bracket and the lower bracket such that the back plate opposes the building wall surface with a predetermined void space maintained by the upper bracket and the lower bracket, the void space having opposed horizontal sides and opposed vertical sides, and the main body case is provided with a soundproof member, which extends vertically on the back plate, and the soundproof member closing:

at least a part of at only one of the horizontal sides of the void space sandwiched at top and bottom by the upper bracket and the lower bracket, respectively;

or at least a part of at least one of the horizontal sides of the void space sandwiched at top and bottom by the upper bracket and the lower bracket, respectively, without closing either of the vertical sides of the void space.

2. The hot-water supply apparatus according to claim 1, wherein the soundproof member is disposed on the back plate at a position closer to one horizontal edge of the back plate than an opposite horizontal edge of the back plate.

3. The hot-water supply apparatus according to claim 2, wherein an entirety of the soundproof member is disposed on the back plate at a position closer to the one horizontal edge of the back plate than the opposite horizontal edge of the back plate.

4. The hot-water supply apparatus according to claim 3, wherein the soundproof member, the upper bracket, and the lower bracket are all separate members.

5. The hot-water supply apparatus according to claim 2, wherein the soundproof member, the upper bracket, and the lower bracket are all separate members.

6. The hot-water supply apparatus according to claim 1, wherein the soundproof member has a greater length in a vertical direction between vertical upper and lower edges of the back plate than a length in a horizontal direction between opposite horizontal edges of the back plate, and an entirety of the soundproof member is disposed on the back plate at a position closer to one horizontal edge of the back plate than an opposite horizontal edge of the back plate.

7. The hot-water supply apparatus according to claim 6, wherein the soundproof member, the upper bracket, and the lower bracket are all separate members.

8. The hot-water supply apparatus according to claim 1, wherein the soundproof member is disposed at a position closer to a horizontal edge of the back plate than a horizontal center of the back plate.

9. The hot-water supply apparatus according to claim 8, wherein the soundproof member, the upper bracket, and the lower bracket are all separate members.

10. The hot-water supply apparatus according to claim 1, wherein the soundproof member, the upper bracket, and the lower bracket are all separate members.

* * * * *